US005315712A

United States Patent [19]

McTaggart

[11] Patent Number: 5,315,712

[45] Date of Patent: May 31, 1994

[54] ADJUSTABLE NECKLINE BLOUSE

[75] Inventor: Nancy B. McTaggart, Richardson, Tex.

[73] Assignee: Lee C. Plaster, Richardson, Tex.

[21] Appl. No.: 896,679

[22] Filed: Jun. 10, 1992

[51] Int. Cl.[5] ..... A41D 1/18

[52] U.S. Cl. ..... 2/106; 2/105; 2/115; 2/133; 2/74; 2/75

[58] Field of Search ..... 2/106, 105, 69, 69.5, 2/115, 133, 217, 74, 75, 88, 98

[56] References Cited

U.S. PATENT DOCUMENTS

| | | | |
|---|---|---|---|
| 724,758 | 4/1903 | Todd | 2/217 |
| 2,668,293 | 2/1954 | Levy | 2/105 |
| 2,687,530 | 8/1954 | Farnum | 2/217 |
| 2,692,988 | 11/1954 | Rouse | 2/217 |
| 2,777,130 | 1/1957 | Keller | 2/75 |
| 3,812,539 | 5/1974 | Muehlberg et al. | 2/69.6 |
| 4,774,726 | 10/1988 | Garrett | 2/106 |

FOREIGN PATENT DOCUMENTS

| | | | |
|---|---|---|---|
| 148295 | 8/1936 | Austria | 2/105 |

*Primary Examiner*—Clifford D. Crowder
*Assistant Examiner*—Gloria Hale
*Attorney, Agent, or Firm*—John E. Vandigriff

[57] ABSTRACT

An adjustable neckline garment has a stretchable neckline and a plurality of adjustment devices spaced along the neckline to permit configuring the neckline to a plurality of different shapes.

11 Claims, 2 Drawing Sheets

ADJUSTABLE NECKLINE BLOUSE

FIELD OF THE INVENTION

This invention relates to clothing, and more particularly to a stretchable neckline blouse with a changeable neckline configuration.

BACKGROUND OF THE INVENTION

When it is desirable to wear a dress or blouse with a particular neck line, a garment with the desired neck line must be worn. When another neck line is desired, then another different garment with the desired neckline must be worn. This is so with each and every different neck line that is to be worn. Basically, each garment has only one neckline design such as the necklines known as V-neckline, square-neckline, sweetheart-neckline and round neckline. Such neck lines are available only on separate garments.

SUMMARY OF THE INVENTION

The invention is to a neckline for a blouse or dress that is adjustable and changeable to be in the outline of anyone of the V-, Square-, sweetheart-, and round necklines.

The invention utilizes a pull-cord device to adjust one to three points on the neckline to adjust its shape. In the basic invention more than the four named neck-lines may be achieved by adjusting specific numbers of pull-cord devices. The necklines can be adjusted with the garment on or off the wearer.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
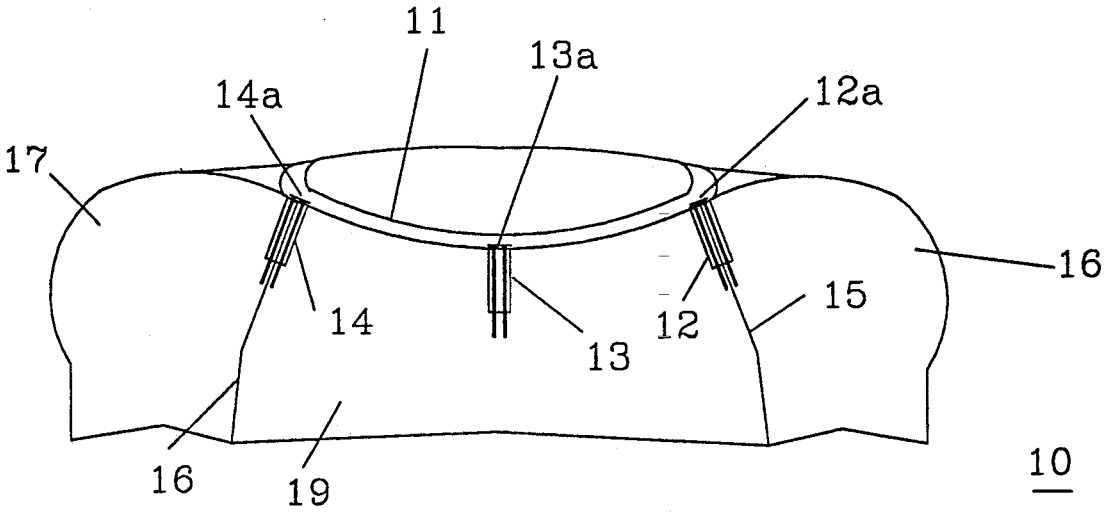
FIG. 1 illustrates a partial view of a blouse utilizing the present invention.

FIG. 1 is a partial view of the inside of a blouse 10 having a neckline 11 that can be adjusted to different configurations including commonly known necklines such as round, V, square and sweetheart. Blouse 10 has one or more adjustment devices positioned around the neckline. In FIG. 1, there are three adjustment devices 12, 13 and 14. In the example illustrated in FIG. 1, adjustment device 13 is in the center front of the neckline. Adjustment devices 14 and 12 are positioned over the seams joining the sleeves to the body of the blouse. For example, sleeve 16 joins blouse body 19 at seam 15, and adjustment device 12 is over seam 15. Sleeve 17 joins the blouse body 19 at seam 16, and adjustment device 14 is over seam 16.

Each adjustment device is adjacent neckline 11 and is stitched to the blouse. A typical neckline 11 will be rolled and stitched with an elastic band inside to provide a gathering of the neckline and to aid in adjusting the neckline.

Figure 2:
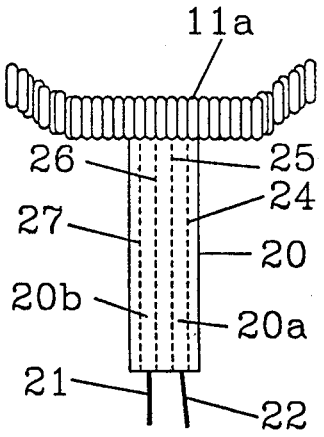
FIG. 2 is the adjustment device of the present invention, in a released condition.

An adjustment device is illustrated in FIG. 2 . The adjustment device has a main body 20 made of two pieces of cloth sewed together and two adjustment cords 21 and 22. Adjustment body 20 has two channels 20*a* and 20*b* formed therein by, for example stitches 24, 25 26 and 27 through the two pieces of cloth. In each channel is a pull-cord, pull-cords 21 and 22. Adjustment device 20 is shown adjacent to neckline 11*a*. Neckline 11*a* has a channel therein (not illustrated) and may have an elastic material in the channel to permit the neckline to "gather" to provide for its adjustment to different neckline configurations.

As illustrated in FIG. 2, neckline 11*a* is gathered as a result of the elastic in the neckline channel.

Figure 2A:
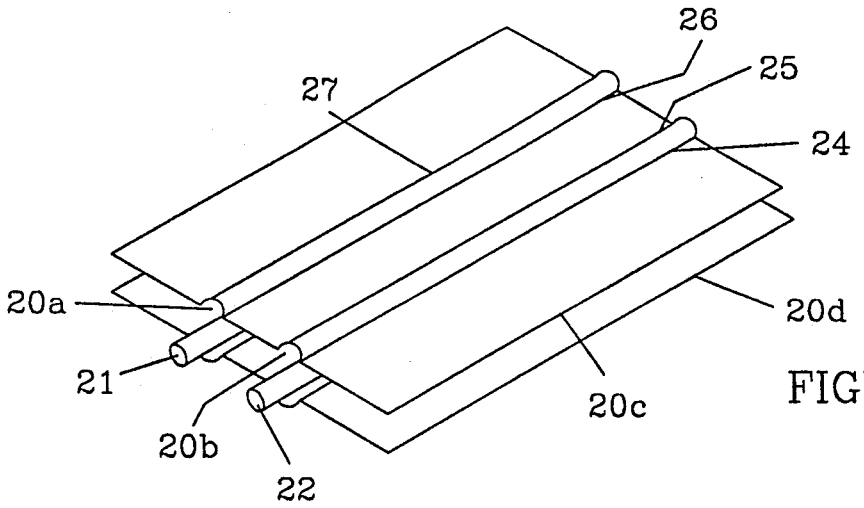
FIG. 2*a* is an exploded view of the adjustment device of FIG. 2.

FIG. 2*a* is an exploded view of the adjustable device of FIG. 2. The body of the device consists of two pieces of material 20*c* and 20*d*. Two cords, 21 and 22, are sewed between the two pieces of material along stitch lines 24, 25 , 26 and 27. The stitch lines are not too close to the cords so that the cords are held by friction, but may be pulled and the material body may be gathered as the cords are pulled. The adjustable device is sewed to the blouse as described below. The device may have a single pull cord, but the adjustment is not as effective as when two are used.

Figure 3:
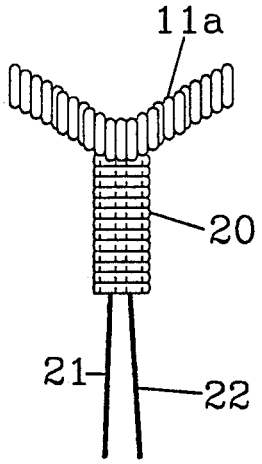
FIG. 3 is the adjustment device of the present invention, in a pulled condition.

FIG. 3 illustrates an adjustment device that has been adjusted or gathered to change the neckline configuration. Pull cords 21 and 22 have been pulled and the device body 20 has been gathered to apply a downward adjustment in neckline. Each adjustment device is stitched to the neckline a illustrated in FIG. 1. The pull-cords in adjustment device 12 are stitched within the neckline at 12*a*. Similarly, pull cords in device 13 are stitched at 13*a* and pull-cords in device 14 are stitched in neckline 11 at 14*a*.

Figure 4:
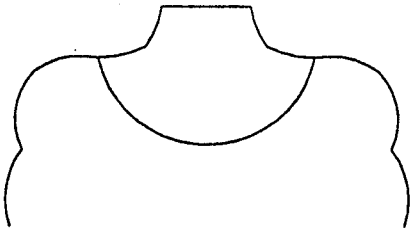
FIG. 4 is a blouse adjusted to a round neckline.

FIG. 4 illustrates a blouse with a round neckline configuration. In this instance none of the adjustment devices have had the pull cords pulled and the adjustment device body gathered.

Figure 5:
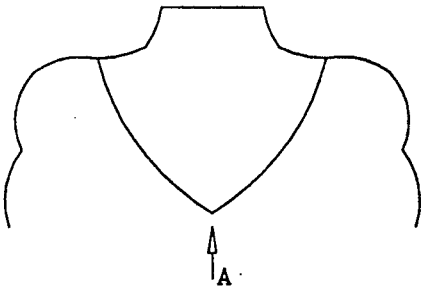
FIG. 5 is a blouse adjusted to a "V" neckline.

FIG. 5 illustrates a blouse with one adjustment device adjusted to configure the neckline in a "V" shape. The center adjustment device at A (13 in FIG. 1) has been adjusted by pulling the pull-cords and the body of the adjustment device gathered while pulling the pull cords.

Figure 6:
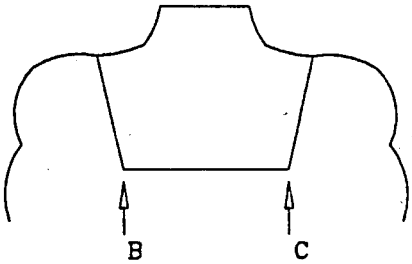
FIG. 6 is a blouse adjusted to a square neckline.

FIG. 6 illustrates a neckline adjusted to a square neck configuration. This configuration is adjusted by adjusting the device at B and C. The adjustment device in these two positions have been adjusted by pulling the pull cords and gathering the body of the adjustment device.

Figure 7:
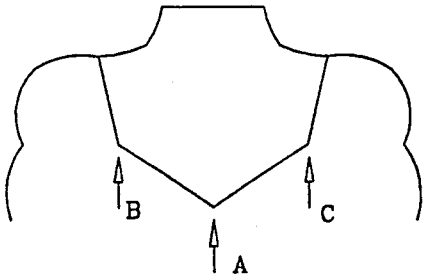
FIG. 7 is a blouse adjusted to a Sweetheart neckline.

FIG. 7 illustrates a neckline adjusted to a sweetheart neck configuration. The sweetheart neckline is accomplished by adjusting the neckline devices at points A, B and C.

Adjustment of the neckline is as follows. The neckline adjustment device is held in one hand and with the other hand the double cords in the device are pulled downward. The fingers are used to assist in gathering the body of the adjustment device as the two cords are pulled downward. Equal downward pressure is applied to each cord. After the cords have been pulled to the desired position, then they are tied to hold the body of the adjustment device in the gathered position. This procedure is repeated for each adjustment device to be adjusted, depending upon the desired neckline configuration.

What is claimed is:

1. An adjustable neckline garment, having an inside worn next to the wearer's body and an outside, comprising a blouse including a body portion and two sleeves attached to the body portion, and as elasticized neckline; and first, second and third neckline adjustment devices, one adjustable device adjacent each of said two sleeves, and a third neckline adjustment device on said body portion equidistant between said first and second neckline adjustment devices, each adjustment device sewn inside said garment and having an end sewn adjacent to the stretchable neckline;

said neckline adjustment devices adjustable to stretch and change the shape of the neckline to at least one of round, sweetheart, V and square configurations.

2. The adjustable neckline garment according to claim 1, wherein said neckline adjustment device includes a main body and at least one pull cord, the pull cord extending out of the main body at one end, and the main body attached to the stretchable neckline at another end.

3. The adjustable neckline garment according to claim 1, wherein said sleeves are attached to said body portion by seams, and that a neckline adjustment device is played over each seam, inside of said garment, between each sleeve and said body portion, adjacent said stretchable neckline.

4. The adjustable neckline garment according to claim 1, wherein said sleeves are attached to said body portion by seams, and that a neckline adjustment device is placed over each seam between each sleeve and said body portion, inside said garment, each of said neckline adjustment devices having an end sewn adjacent said stretchable neckline.

5. The adjustable neckline garment according to claim 1, wherein said neckline adjustment device includes a main body and two parallel pull cords, the pull cords extending out of the main body at one end, and the main body attached to the stretchable neckline at another end.

6. An adjustable neckline garment, having an inside worn next to the wearer's body and an outside, comprising:

a blouse including a body portion and two sleeves attached to the body portion, and an elasticized neckline;

a plurality of neckline adjustment devices sewn adjacent to the stretchable neckline on the inside of said garment, wherein said sleeves are attached to said body portion by seams, and that a neckline adjustment device is placed over each seam, inside said garment, between each sleeve and said body portion;

each neckline adjustment device adjustable to change the shape of the stretchable neckline to at least one of round, sweetheart, V and square configurations.

7. The adjustable neckline garment according to claim 5, wherein said neckline adjustment devices includes a main body having two pull cords extending through said main body.

8. The adjustable neckline garment according to claim 5, wherein said sleeves are attached to said body portion by seams, and that a neckline adjustment device is placed over each seam between each sleeve and said body portion, inside said garment, each of said neckline adjustment devices having an end sewn adjacent said stretchable neckline.

9. A method of making an adjustable neckline garment, having an inside worn next to the wear's body and an outside, and said garment has a body and sleeves attached to said body by seams, comprising the steps of:

sewing an elasticized neckline into a garment; and sewing an adjustable device over each seam, inside said garment and adjacent to the neckline, where a sleeve is sewed to the body.

10. The method according to claim 9, including the step of sewing an adjustable device, inside said garment and adjacent to the an elasticized neckline, midway between the adjustable devices over the seam where a sleeve is sewed to the body.

11. The method according to claim 9, wherein said neckline adjustment device includes a main body and two parallel pull cords, the pull cords extending out of the main body at one end, and the main body attached to the stretchable neckline at another end, including the step of adjusting the neckline to a desired configuration by gathering the main body with the pull cords, and tying the pull cords together to hold the main body in a gather position and the neckline in the desired configuration.

* * * * *